US010941918B1

(12) United States Patent
Happy

(10) Patent No.: US 10,941,918 B1
(45) Date of Patent: Mar. 9, 2021

(54) VEHICLE LAMP ASSEMBLY

(71) Applicant: Nissan North America, Inc., Franklin, TN (US)

(72) Inventor: Kyle Happy, Whitmore Lake, MI (US)

(73) Assignee: Nissan North America, Inc., Franklin, TN (US)

( * ) Notice: Subject to any disclaimer, the term of this patent is extended or adjusted under 35 U.S.C. 154(b) by 0 days.

(21) Appl. No.: 16/555,071

(22) Filed: Aug. 29, 2019

(51) Int. Cl.

| | |
|---|---|
| ***F21S 43/27*** | (2018.01) |
| ***F21S 43/14*** | (2018.01) |
| ***F21V 19/00*** | (2006.01) |
| ***F21V 5/04*** | (2006.01) |
| ***F21V 17/00*** | (2006.01) |
| ***F21W 103/45*** | (2018.01) |
| ***F21Y 115/10*** | (2016.01) |
| ***F21W 103/35*** | (2018.01) |
| ***F21W 103/20*** | (2018.01) |

(52) U.S. Cl.
CPC ..... *F21S 43/27* (2018.01); *F21S 43/14* (2018.01); *F21V 5/045* (2013.01); *F21V 17/005* (2013.01); *F21V 19/003* (2013.01); *F21W 2103/20* (2018.01); *F21W 2103/35* (2018.01); *F21W 2103/45* (2018.01); *F21Y 2115/10* (2016.08)

(58) Field of Classification Search
CPC ..... F21S 43/27; F21S 43/14; F21S 41/141; F21S 41/143; F21S 41/275; F21S 43/26; F21S 41/285; H01L 33/58; F21V 5/045; F21V 19/003; F21V 17/005; F21Y 2115/10; F21W 2103/45; F21W 2103/20; F21W 2103/35
See application file for complete search history.

(56) References Cited

U.S. PATENT DOCUMENTS

| | | | | |
|---|---|---|---|---|
| 8,974,101 | B2 * | 3/2015 | Koizumi | F21S 43/14 362/522 |
| 9,297,512 | B2 * | 3/2016 | Inada | F21V 5/045 |
| 10,323,824 | B1 * | 6/2019 | Lim | F21K 9/275 |
| 2015/0062916 | A1 * | 3/2015 | Takayama | F21V 13/04 362/308 |
| 2019/0128503 | A1 * | 5/2019 | Irgang | F21V 5/008 |

OTHER PUBLICATIONS

U.S. Appl. No. 16/173,684; Headlamp Structure; S Ford; filed Oct. 29, 2018.

* cited by examiner

*Primary Examiner* — Peggy A Neils
(74) *Attorney, Agent, or Firm* — Global IP Counselors, LLP

(57) ABSTRACT

A vehicle lamp assembly includes a lamp lens having a smooth surface and a contoured surface. The contoured has a first portion, a second portion and a central section that together define a linear Fresnel lens. The first portion has a plurality of first parallel grooves and projections shaped to direct light passing therethrough in predetermined directions. The second portion has a plurality of second parallel grooves and projections shaped to direct light passing therethrough in directions approximately parallel to the predetermined directions of the first portion. The central section is disposed between the first portion and the second portion and has a first section with a vertex located a first distance from the smooth surface and a second section with a vertex located a second distance away from the smooth surface. The first section and the second section are adjacent to one another.

15 Claims, 5 Drawing Sheets

VEHICLE LAMP ASSEMBLY

BACKGROUND

Field of the Invention

The present invention generally relates to a vehicle lamp assembly. More specifically, the present invention relates to a vehicle lamp assembly having a lamp lens formed with a pair of modified linear Fresnel lenses configured to change characteristic of reflecting light therefrom.

Background Information

Fresnel lenses typically consist of a series of concentric grooves etched into plastic (a circular Fresnel lens). Their thin, lightweight construction, availability in small as well as large sizes, and excellent light gathering ability make them useful in a variety of applications. Fresnel lenses are most often used in light gathering applications, such as condenser systems or emitter/detector setups. They can also be used as magnifiers or projection lenses in illumination systems, and image formulation.

A Fresnel lens replaces the curved surface of a conventional optical lens with a series of concentric grooves. These contours act as individual refracting surfaces, bending parallel light rays to a common focal length. As a result, a Fresnel lens, while physically narrow in profile, is capable of focusing light similar to a conventional optical lens but has several advantages over its thicker counterpart.

A linear Fresnel lens uses straight segments that appear as straight lines rather than arcs. In cross-section, a linear lens usually has the same or about the same cross-section as a circular Fresnel lens (taken along a center line of the circular Fresnel lens). These lenses focus light into a narrow band. They do not produce a sharp image, but can be used, for example, in vehicle exterior lighting application.

SUMMARY

One object of the present disclosure is to provide a lamp assembly a modified Fresnel lens that reduces incidences of reflected light from the Fresnel lens when the lamp assembly is inactive.

In view of the state of the known technology, one aspect of the present disclosure is to provide a vehicle lamp assembly with a lamp lens having a smooth surface and a contoured surface. The contoured has a first portion, a second portion and a central section that together define a linear Fresnel lens. The first portion has a plurality of first parallel grooves and projections shaped to direct light passing therethrough in predetermined directions. The second portion has a plurality of second parallel grooves and projections shaped to direct light passing therethrough in directions approximately parallel to the predetermined directions of the first portion. The central section is disposed between the first portion and the second portion, and, has a first section with a vertex located a first distance from the smooth surface and a second section with a vertex located a second distance away from the smooth surface. The first section and the second section are adjacent to one another.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
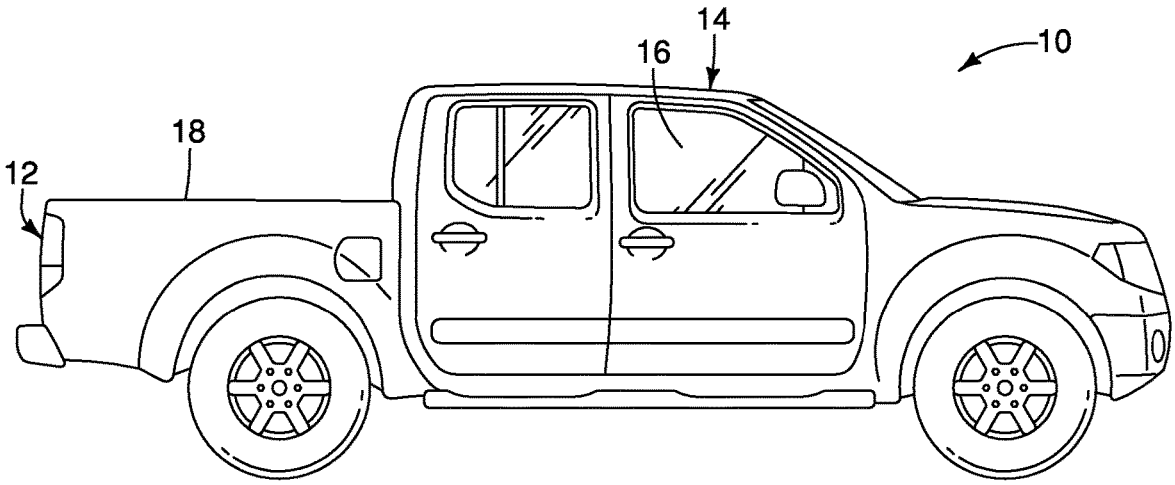
FIG. 1 is a side view of a vehicle that includes a lamp assembly installed at a rear end of the vehicle in accordance with one embodiment.
Figure 2:
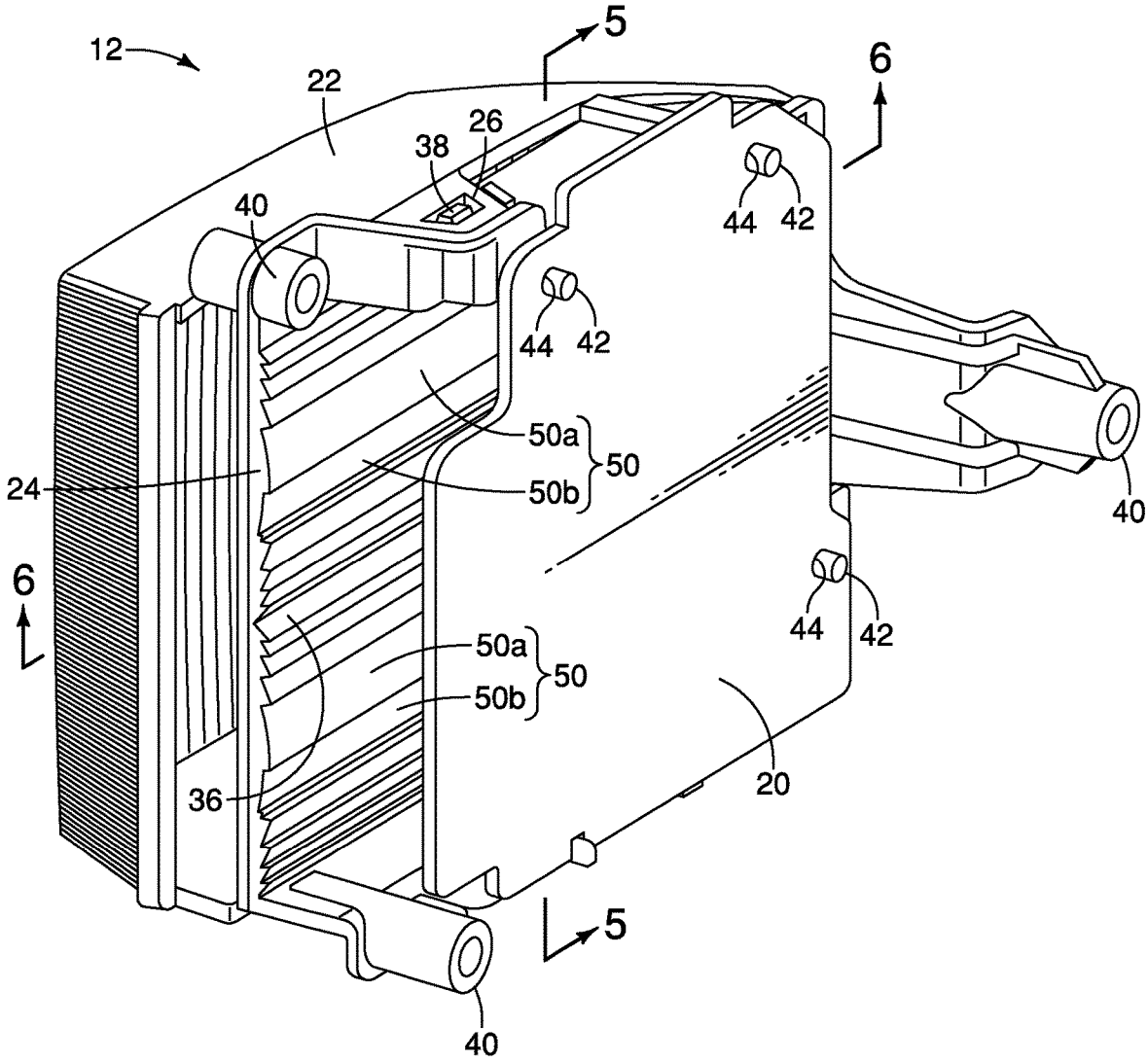
FIG. 2 is a perspective view of a forward side of the lamp assembly shown removed from the vehicle in accordance with the one embodiment.

Referring initially to FIG. 1, a vehicle 10 that includes a vehicle lamp assembly 12 is illustrated in accordance with a first embodiment.

The vehicle 10 has a vehicle body structure 14 that includes structures defining a passenger compartment 16 and structures that define a cargo area 18. Since passenger compartments and cargo areas are conventional structures, further description is omitted for the sake of brevity.

As shown in FIGS. 2-6, the vehicle lamp assembly 12 (hereinafter the lamp assembly 12) includes a circuit board 20, an outer lens cover 22 and a lamp lens 24. The lamp assembly 12 in the depicted embodiment is a rear tail lamp assembly, such as a brake lamp, turn signal lamp and/or a backup lamp. Alternatively, the lamp assembly 12 can be a front turn signal lamp, or any lamp assembly located on the vehicle 10.

The circuit board 20 has at least one illumination device **20*a* and is manufactured to have a dark or black appearance, as is explained further below. In the depicted embodiment, there are six (6) of the illumination devices 20*a*. The illumination devices 20*a* are fixed to the circuit board 20 at predetermined locations. The illumination devices 20*a*** LEDs (light emitting diodes).

The outer lens cover 22 is basically a transparent element that is designed and shaped to emit light produced by the illumination devices **20*a* after the emitted light has passed through the lamp lens 24, as described in greater detail below. The outer lens cover 22 includes a plurality of attachment flanges 26 that snap fit to the lamp lens 24 in a conventional manner. Alternatively, the outer lens cover 22 can alternatively, or additionally be attached to the lamp lens 24 via fasteners (not shown) and/or adhesive. The outer lens cover 22** can be provided with a plurality of light dispersing ridges or projections or can be provided with a smooth finish.

Figure 4:
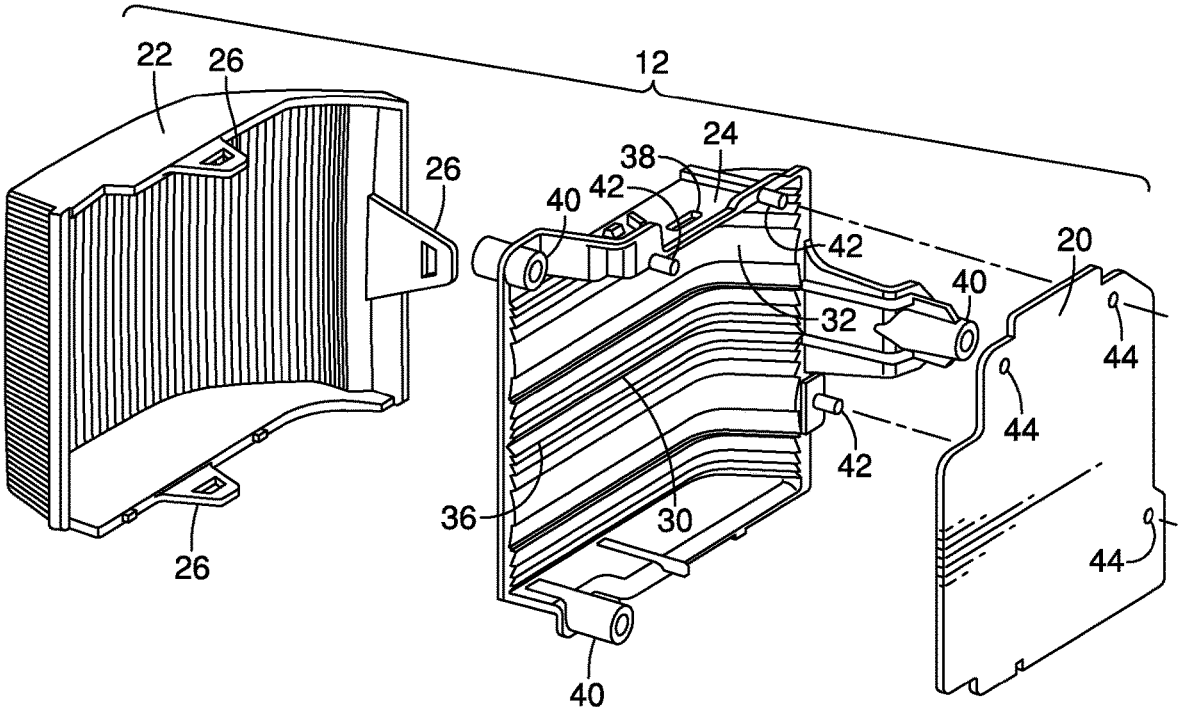
FIG. 4 is an exploded view of a forward side of the lamp assembly showing the outer lens cover, the lamp lens and the circuit board in accordance with the one embodiment.
Figure 5:
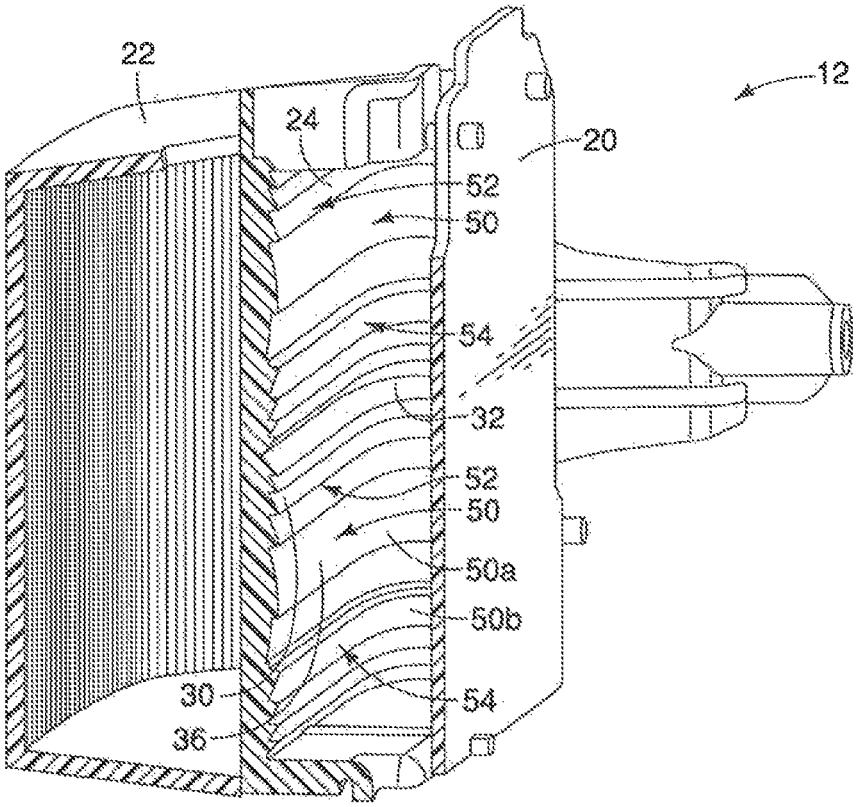
FIG. 5 is a cross-sectional view of the lamp assembly taken along the line 5-5 in FIG. 2 in accordance with the one embodiment.

The circuit board 20 attaches to the lamp lens 24 via fasteners, as shown in FIG. 4. Consequently, the lamp lens 24 is supported to (attached to) the circuit board 20 and the outer lens cover 22 with the lamp lens 24 being located between the circuit board 20 and the outer lens cover 22.

Figure 6:
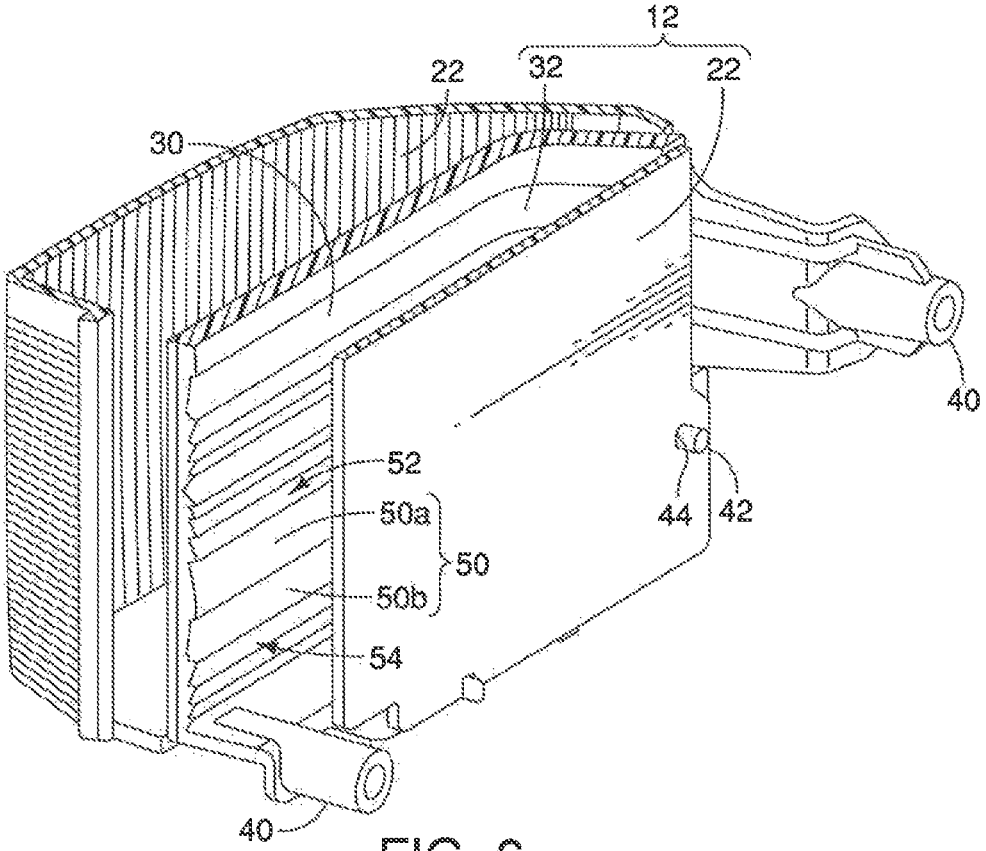
FIG. 6 is a cross-sectional view of the lamp assembly taken along the line 6-6 in FIG. 2 in accordance with the one embodiment.
Figure 7:
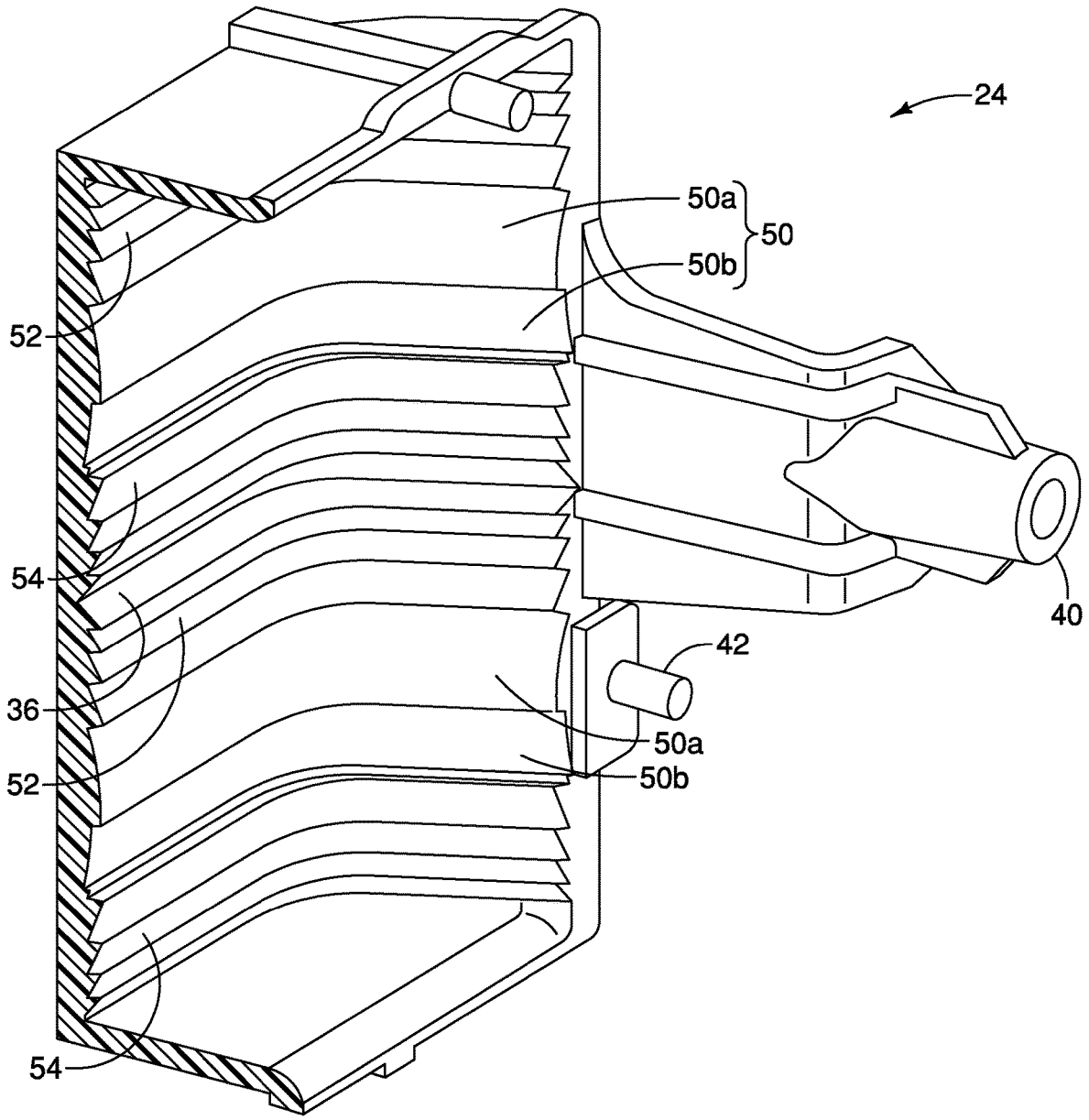
FIG. 7 is a cross-sectional view of the lamp lens with the outer lens cover and the circuit board removed in accordance with the one embodiment.

As shown in FIGS. 4, 6 and 7, the lamp lens 24 includes a generally straight section 30 (generally planar) and a curved section 32. The straight section 30 and the curved section 32 are formed as one and have continuous uninterrupted lens features formed thereon, as described further below.

The lamp lens 24 further defines a smooth surface 34 that generally faces rearward and a contoured surface 36 (a forward-facing surface). The smooth surface 34 is preferably a surface with few or no surface contours, and, is smooth and uninterrupted. The smooth surface 34 and the contoured surface 36 continue along both the straight section 30 and the curved section 32.

The lamp lens 24 further includes a plurality of projections 38 positioned to snap-fit into openings of corresponding ones of the plurality of attachment flanges 26 of the outer lens cover 22. The lamp lens 24 further includes a plurality of attachment extensions 40 that receive fasteners (not shown) to attach the lamp assembly 12 to the vehicle 10. The lamp lens 24 also includes a plurality of alignment pins 42 that fit into corresponding alignment apertures 44 in the circuit board 20 for properly aligning the circuit board 20 and the illumination devices 20*a* (LEDs) with the lamp lens 24. The alignment pins 42 can also be used to fix the circuit board 20 to the lamp lens 24 via fasteners (not shown) or by heat stacking (melting a distal end of each alignment pin 42, thereby enlarging it to contact and hold the circuit board 20 to the lamp lens 24).

The contoured surface 36 defines two parallel linear Fresnel lenses. Each of the Fresnel lenses is formed on the contoured surface 36 and are parallel to one another, with one being located above the other. Each of the Fresnel lenses is a linear lens and extend horizontally along the contoured surface 36. Each of the Fresnel lenses is defined by a central lens section 50 (a central section), a first portion 52 (a first portion) and a second portion 54 (a second portion). Hence, the contoured surface 36 has two central lens portions 50, two of the first sections 52 and two of the second portion 54. For the sake of brevity, only one of the linear Fresnel lenses on the contoured surface 36 is described herein below. However, it should be understood from the drawings and the description herein, that the two linear Fresnel lenses defined on the contoured surface 36 are identical to one another.

As shown in FIGS. 5-8, the first portion 52 is defined by a plurality of first parallel grooves and projections shaped to direct light passing therethrough in predetermined directions in a manner consistent with a linear Fresnel lens. The second portion 54 is defined by a plurality of second parallel grooves and projections shaped to direct light passing therethrough in directions approximately parallel to the predetermined directions of the first portion 52 in a manner consistent with a linear Fresnel lens. As well, the surface contours that define the first portion 52 and the surface contours that define the second portion 54 are symmetrical mirror images of one another about a center line $C_L$ (FIG. 8) that is defined by and extends through the central lens section 50, perpendicular to the contoured surface 36 and the smooth surface 34, as viewed in cross-section in FIG. 8.

Figure 3:
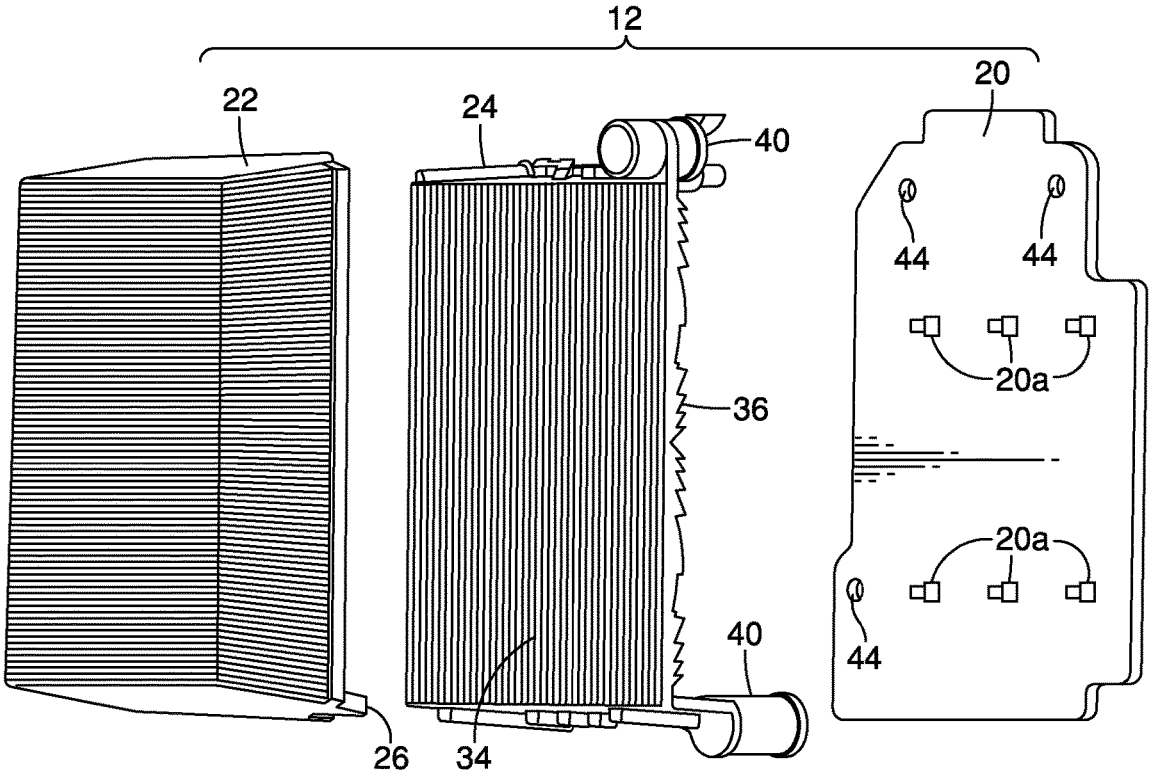
FIG. 3 is an exploded view of a rearward side of the lamp assembly showing an outer lens cover, a lamp lens and a circuit board that includes a plurality of illumination devices (light emitting diodes) in accordance with the one embodiment.
Figure 8:
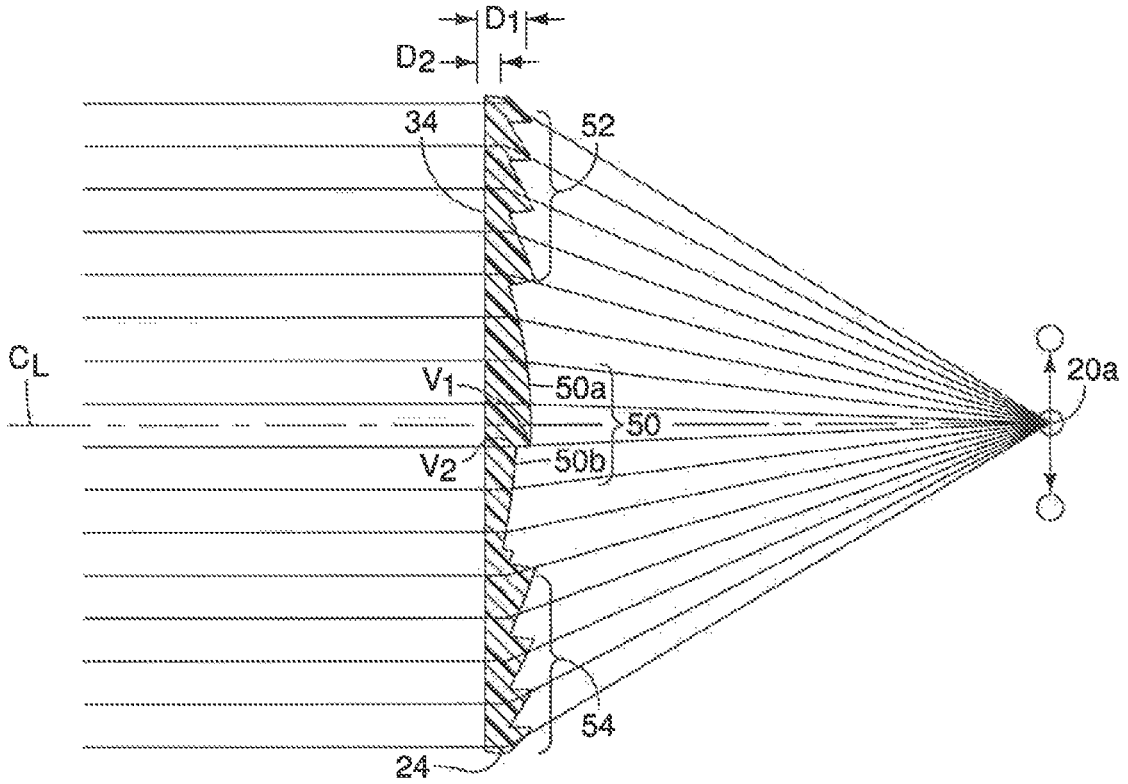
FIG. 8 is a schematic, cross-sectional view of one of the Fresnel lenses defined on the lamp lens in accordance with the one embodiment.

As shown in FIGS. 3 and 8, the illumination devices 20*a* (LEDs) are positioned along the center line $C_L$ (FIG. 8) and are further aligned with corresponding focal points of the linear Fresnel lens, as viewed in cross-section. The focal point (location of the illumination devices 20*a* in FIG. 8) of each of the Fresnel lenses coincides with the center line $C_L$. FIG. 8 shows a representation of the center line $C_L$ for one of the two linear Fresnel lenses. However, it should be understood that for a linear Fresnel lens, the focal point is a horizontal plane coinciding with the focal center line $C_L$. Hence, the six illumination devices 20*a* shown in FIG. 3 correspond to the plane of the focal points of a corresponding one of the linear Fresnel lenses defined on the contoured surface 36 of the lamp lens 24. More specifically, the three upper illumination devices 20*a* shown in FIG. 3 lie along a horizontal plane that coincides with a center of the central lens section 50 of the upper of the two Fresnel lenses form on the contoured surface 36 of the lamp lens 24. Similarly, the three lower illumination devices 20*a* shown in FIG. 3 lie along another horizontal plane that coincides with a center of the central lens section 50 of the lower of the two Fresnel lenses form on the contoured surface 36 of the lamp lens 24.

Figure 9:
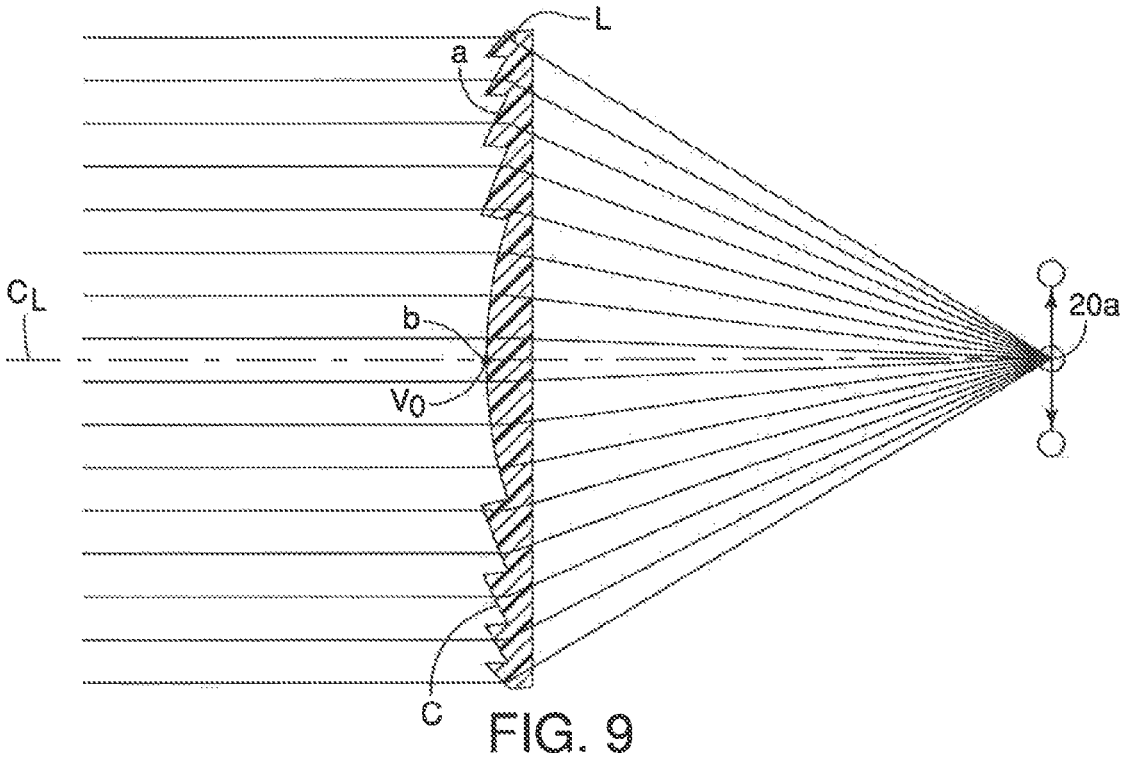
FIG. 9 Prior Art
FIG. 9 is a schematic, cross-sectional view of a conventional Fresnel lens.

The difference between the Fresnel lenses of the lamp lens 24 (FIG. 8) and a conventional Fresnel lens L (FIG. 9) is now provide with specific reference to FIGS. 8 and 9. The conventional Fresnel lens L shown in cross-section in FIG. 9, includes a first lens section a, a central lens section b and a second lens section c. As shown in FIG. 9, the central lens section b has a parabolic-like shape with a vertex $V_0$ located along a centerline $C_L$ of the conventional Fresnel lens L. The conventional Fresnel lens L is symmetrical (mirror image) about the centerline $C_L$. The central lens section b has a vertex $V_0$ that is located on the centerline $C_L$. Since the basic geometry and optical properties of a conventional Fresnel lenses are well known, further description of a conventional Fresnel lens L is omitted for the sake of brevity.

The central lens section 50 of the linear Fresnel lens is divided into a first section 50*a* and a second section 50*b*. The first section 50*a* and the second section 50*b* are offset from one another along the center line $C_L$.

Each of the first section 50*a* and a second section 50*b* a parabolic-like shape. However, the first section 50*a* of the central lens section 50 is only half of a central lens section, and the second section 50*b* is only half of a central lens section, as viewed in cross-section in FIG. 8. In fact, the first section 50*a* and the second section 50*b* can be considered to be a single central lens section 50 that has been cut in half along its centerline at its vertex, with one half being offset along the centerline. Specifically, as shown in FIG. 8, the first section 50*a* has a vertex $V_1$ that is a first distance $D_1$ away from the smooth surface 34. The second section 50*b* has a vertex $V_2$ that is a second distance $D_2$ away from the smooth surface 34. The first distance $D_1$ is greater than the distance $D_2$.

The first section 50*a* and the second section 50*b* are adjacent to one another with their respective vertices $V_1$ and $V_2$ coinciding with the center lines $C_L$. Further, the first section 50*a* has a first predefined partial parabolic profile as viewed in cross-section. Similarly, the second section 50*b* has a second predefined partial parabolic profile as viewed in cross-section that is a mirror image of the first predefined partial parabolic profile (ignoring the linear offset therebetween).

The inclusion of the first section 50*a* and the second section 50*b* in the central lens section 50 has no appreciable effect on the light transmitting characteristics when the illumination devices 20*a* are provided with electric power and are emitting light through the lamp lens 24. Specifically, as shown in a comparison between FIG. 8 and FIG. 9, light from the illumination devices 20*a* travels through the central lens portion 50 (with first section 50*a* and the second section 50*b*) with basically the same light directing characteristics as the conventional Fresnel lens L shown in FIG. 9.

The advantage of inclusion of the first section 50*a* and the second section 50*b* in the central lens section 50 is apparent when the illumination devices 20*a* are turned off. With no internal illumination from the illumination devices 20*a*, light from outside the lamp assembly 12 shines on and into the lamp lens 24 and generating reflected and diffused illumination.

As mentioned above, the circuit board 20 has a dark or black appearance. The outer lens cover 22 and the lamp lens 24 are basically transparent or at the very least translucent. Therefore, with the illumination devices 20*a* turned off, the lamp assembly 12 has a relatively dark appearance.

When light shines on and into a conventional lamp assembly that includes a conventional Fresnel lens such as the conventional Fresnel lens L shown in FIG. 9, light can reflect back out of the conventional lamp assembly and can produce undesirable reflections to those observing it. In certain instances, reflected light from a conventional lamp assembly having a conventional Fresnel lens can give the appearance of being self-illuminated (turned on by a vehicle operator) even when not turned on (not being self-illuminated).

In the lamp assembly 12 with the modified Fresnel lens of the lamp lens 24, reflected light is more evenly dispersed providing a more desirable appearance. At the very least, light reflected from the lamp assembly 12 with the lamp lens 24 does not give the appearance of being self-illuminated (turned on). Hence, the modified linear Fresnel lenses formed on the contoured surface 36 of the lamp lens 24 provides a desirable effect when exterior light illuminates the lamp assembly 12.

The various elements and features of the vehicle 10, other than the lamp assembly 12, are conventional components that are well known in the art. Since vehicle elements and features of the vehicle 10 are well known in the art, these structures will not be discussed or illustrated in detail herein. Rather, it will be apparent to those skilled in the art from this disclosure that the components can be any type of structure and/or programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment, the following directional terms "forward", "rearward", "above", "downward", "vertical", "horizontal", "below" and "transverse" as well as any other similar directional terms refer to those directions of a vehicle equipped with the vehicle lamp assembly. Accordingly, these terms, as utilized to describe the present invention should be interpreted relative to a vehicle equipped with the vehicle lamp assembly.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A vehicle lamp assembly, comprising:

a lamp lens having a smooth surface and a contoured surface, the contoured surface having a first portion, a second portion and a central section that together define a linear Fresnel lens, the first portion having a plurality of first parallel grooves and projections shaped to direct light passing therethrough in predetermined directions, the second portion having a plurality of second parallel grooves and projections shaped to direct light passing therethrough in directions approximately parallel to the predetermined directions of the first portion, and the central section being disposed between the first portion and the second portion and having a first section with a vertex located a first distance from the smooth surface and a second section with a vertex located a second distance away from the smooth surface, the first section and the second section being adjacent to one another, the first section having a first predefined partial parabolic profile as viewed in cross-section, and the second section having a second predefined partial parabolic profile as viewed in cross-section that is a mirror image of the first predefined partial parabolic profile linearly offset from the first predefined partial parabolic profile along the center line of the lamp lens.

2. The vehicle lamp assembly according to claim 1, wherein the vertex of the first section and the vertex of the second lens surface define a center line of the lamp lens, as viewed in cross-section.

3. The vehicle lamp assembly according to claim 1, further comprising a circuit board having at least one illumination device; and an outer lens cover, with the lamp lens being supported between the circuit board and the outer lens cover.

4. The vehicle lamp assembly according to claim 1, further comprising the at least one illumination device includes at least one LED (light emitting diode) that is aligned with a focal point of the linear Fresnel lens, as viewed in cross-section.

5. A vehicle lamp assembly, comprising:

a lamp lens having a smooth surface and a contoured surface, the contoured surface at least partially defining a linear Fresnel lens having a central lens portion as viewed in cross-section, the central lens portion having a first section and a second section, the central lens portion defining a center line extending therethrough perpendicular to the smooth surface, the first section and the second section being offset from one another along the center line, as viewed in cross-section, the first section having a first predefined partial parabolic profile as viewed in cross-section, and the second section having a second predefined partial parabolic profile as viewed in cross-section that is a mirror image of the first predefined partial parabolic profile linearly offset from the first predefined partial parabolic profile along the center line of the lamp lens.

6. The vehicle lamp assembly according to claim 5, wherein the first section of the central lens portion has a vertex at the center line, the vertex located a first distance from the smooth surface, and the second section has a vertex located a second distance away from the smooth surface, the first section and the second section being adjacent to one another.

7. The vehicle lamp assembly according to claim 5, wherein the contoured surface of the lamp lens further includes a first portion and a second portion that together with the central lens portion define the linear Fresnel lens, the first portion has a plurality of first parallel grooves and projections shaped to direct light passing therethrough in predetermined directions, and the second portion has a plurality of second parallel grooves and projections shaped to direct light passing therethrough in directions approximately parallel to the predetermined directions of the first portion.

8. The vehicle lamp assembly according to claim 5, further comprising a circuit board having at least one illumination device; and an outer lens cover, with the lamp lens being supported between the circuit board and the outer lens cover.

9. The vehicle lamp assembly according to claim 8, further comprising the at least one illumination device includes at least one LED (light emitting diode) that is aligned with a focal point of the linear Fresnel lens, as viewed in cross-section, the focal point coinciding with the center line.

10. A vehicle lamp assembly, comprising a circuit board having at least one illumination device;

an outer lens cover; and a lamp lens having a smooth surface and a contoured surface, the contoured surface defining a linear Fresnel lens having a central lens portion, the central lens portion having a first section and a second section, the central lens portion defining a center line extending therethrough perpendicular to the smooth surface, the first section and the second section being offset from one another along the center line, as viewed in cross-section, the first section has a first predefined partial parabolic profile as viewed in cross-section, and the second section having a second predefined partial parabolic profile as viewed in cross-section that is a mirror image of the first predefined partial parabolic profile and is linearly offset from the first predefined partial parabolic profile along the center line of the lamp lens.

11. The vehicle lamp assembly according to claim 10, wherein the first section of the central lens portion has a vertex at the center line, the vertex located a first distance from the smooth surface, and the second section has a vertex located a second distance away from the smooth surface.

12. The vehicle lamp assembly according to claim 11, wherein the first section and the second section are adjacent to one another.

13. The vehicle lamp assembly according to claim 10, wherein the contoured surface of the lamp lens further includes a first portion and a second portion that together with the central lens portion define the linear Fresnel lens, the first portion has a plurality of first parallel grooves and projections shaped to direct light passing therethrough in predetermined directions, and the second portion has a plurality of second parallel grooves and projections shaped to direct light passing therethrough in directions approximately parallel to the predetermined directions of the first portion, the central lens portion being located between the first portion and the second portion.

14. The vehicle lamp assembly according to claim 10, wherein the at least one illumination device includes at least one LED (light emitting diode) that is aligned with a focal point of the linear Fresnel lens and the center line, as viewed in cross-section.

15. The vehicle lamp assembly according to claim 10, wherein the illumination device includes a plurality of LEDs (light emitting diodes), the plurality of LEDs being aligned with a focal point of the linear Fresnel lens and the center line.

* * * * *